United States Patent [19]

Hicks

[11] 4,276,989

[45] Jul. 7, 1981

[54] CLOSURES

[76] Inventor: David M. Hicks, 13 Janet St., East Keilor, 3033, Victoria, Australia

[21] Appl. No.: 89,893

[22] Filed: Oct. 31, 1979

[30] Foreign Application Priority Data

Nov. 6, 1978 [AU] Australia ..... PD6664

[51] Int. Cl.[3] ..... B65D 53/00

[52] U.S. Cl. ..... 215/270; 215/341; 215/344; 215/DIG. 1

[58] Field of Search ..... 215/270, 344, DIG. 1, 215/341

[56] References Cited

U.S. PATENT DOCUMENTS

| | | | |
|---|---|---|---|
| 2,587,327 | 2/1952 | Jesnig | 215/344 X |
| 3,074,579 | 1/1963 | Miller | 215/DIG. 1 |
| 3,232,470 | 2/1966 | Gibson | 215/DIG. 1 |
| 3,360,149 | 12/1967 | Roth | 215/344 |
| 3,583,591 | 6/1971 | Hayashida | 215/DIG. 1 |
| 3,802,590 | 4/1974 | Culver | 215/DIG. 1 |
| 4,069,937 | 1/1978 | Smalley | 215/DIG. 1 |

FOREIGN PATENT DOCUMENTS

| | | | |
|---|---|---|---|
| 1229322 | 4/1971 | United Kingdom | 215/DIG. 1 |

*Primary Examiner*—Donald F. Norton

*Attorney, Agent, or Firm*—Scully, Scott, Murphy & Presser

[57] ABSTRACT

The present invention provides a closure comprising a top, a depending skirt, and a flange depending from the top and spaced from the skirt and which is adapted to form a seal with the outside side wall of the neck of a container.

9 Claims, 6 Drawing Figures

CLOSURES

FIELD OF THE INVENTION

This invention relates to closures. In an aspect this invention relates to closures for bottles and jars.

SUMMARY OF THE INVENTION

The present invention provides a closure comprising a top, a depending skirt, and a flange depending from the top and spaced from the skirt and which is adapted to form a seal with the outside side wall of the neck of a container.

PREFERRED ASPECTS OF THE INVENTION

The skirt is preferably internally screw threaded but alternatively a snap, lug or annular ring or rings may be used to effect holding of the closure to the container.

Preferably there is an abutment on the underside of the top adapted to space the top, in use, above the top seal surface of the container so that after the abutment has come into abutting relation with that surface further downward movement of the skirt on to the container will cause a pivoting about the abutment having an inward component of motion which will more tightly than otherwise force said flange into engagement with the container.

Preferably, said flange is such that doming of the closure in use in consequence of internal pressure within the container will cause an inward component of motion of said flange which will more tightly than otherwise seal the container.

Preferably there is in addition to said flange, hereinafter called "said capture or said first flange", a resilient, second flange on the depending skirt extending inwardly and which is deformable on moving the closure onto the finish of the container to conform against the outside side wall of the neck of the container and wherein said capture flange is adapted to engage with said resilient flange to force said resilient flange into close conformity with the outside side wall or the top radius of the neck of the container.

Preferably said resilient flange is deformed upwardly and outwardly.

Preferably the closure includes a capture flange adapted to engage with said resilient flange to force said resilient flange into close conformity with the side wall of said neck.

Preferably said neck includes a step and the capture flange is such as to force said resilient flange over and into close conformity with the step.

Preferably the capture flange and said resilient flange at least in part define a closed annular chamber.

Preferably said chamber is located, in use, adjacent the top seal surface of the finish of the container.

Preferably said resilient flange is so located that pressure within the container tending to escape will press said resilient flange into close conformity with said neck.

Preferably, the closure includes an abutment on the underside of the top. That abutment can serve several purposes. Firstly, it may come into abutting relation with the top seal surface of the container. Secondly, the abutment can cause the top to be spaced above the top seal surface so that after the abutting relation is established further tightening of the screw threads of the skirt onto the container will cause a pivoting about the abutment which has an inward component of motion which will more tightly than otherwise force said resilient flange and said capture flange into engagement with the container. Thirdly, gas pressure within the container can cause a doming upwards of the top inboard of said abutment and this will cause similar pivoting.

Preferably the closure is such as to vent the container relatively early in the process of unscrewing the closure rather than relatively late in the process. This can be achieved by locating said resilient flange to be more adjacent the top than the free end of the skirt.

The closure is preferably a one piece moulding and is preferably of resilient synthetic plastics material. Exemplary but not exclusive materials include polypropylene and polyethylene.

No sealant compounds or wads need be used with the closure of this invention.

The form of the finish of the container need be in no way unusual and the closure of this invention is usable with a number of standard finishes. Naturally, its dimensions should be appropriate to any particular finish. In particular, the closure can be used with the Alcoa finish which has found wide acceptance in the industry.

The closure may be fitted with a pilfer detecting seal which will produce visible evidence of a prior attempt to remove the closure from the container. In one instance of this an annular ring is provided on the free end of the skirt which can engage with a bead or other protrusion on the container. In this instance the arrangement is such that the annular ring will at least partly break away from the skirt if an attempt is made to remove the closure from the container.

The resilient flange may be dimensioned to suit requirements but in general a thickness of 0.010 to 0.020 inch is preferred. The free edge of the resilient flange is preferably tapered. A taper of 3°–5° is generally preferred.

The container itself may be made of any convenient material although glass and synthetic plastics materials will be most usual.

A specific construction of a closure in accordance with this invention will now be described with the aid of the accompanying drawings.

DETAILED DESCRIPTION WITH RESPECT TO THE DRAWINGS

Figure 1:
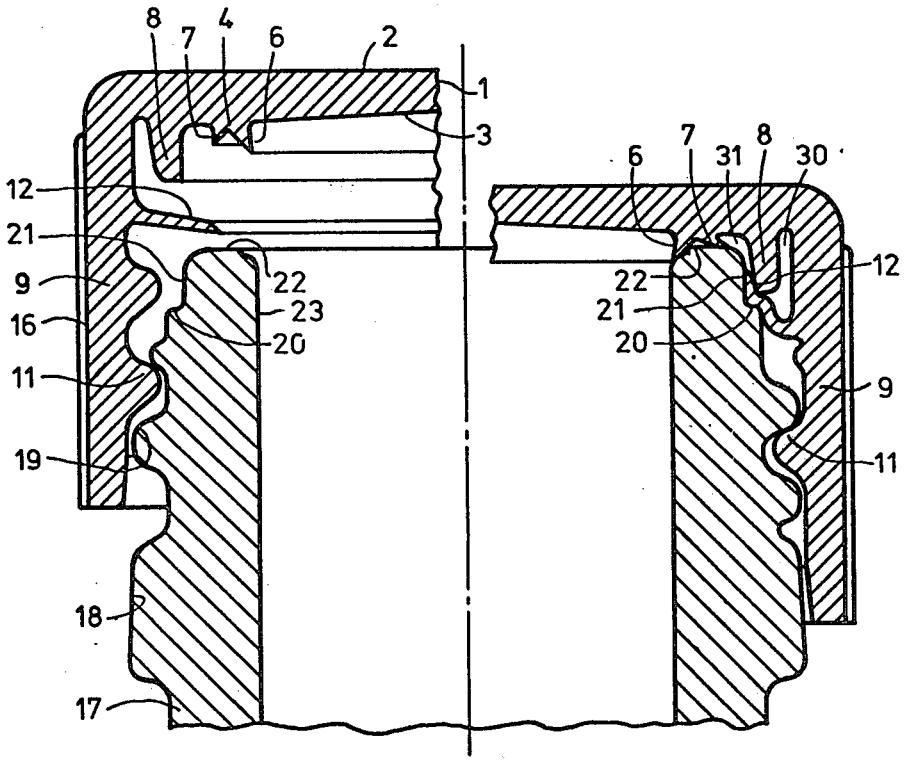
Figure 2:
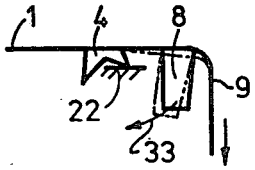
Figure 3:
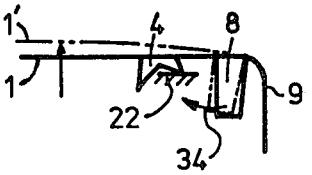
Figure 4:
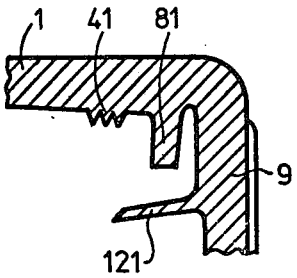
Figure 5:
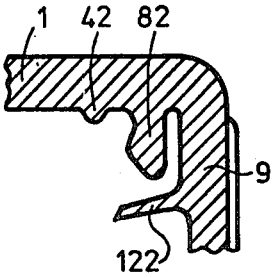
Figure 6:
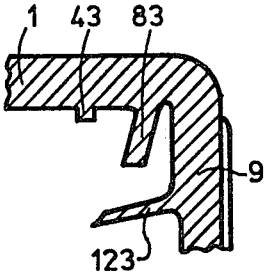

FIG. 1 is a cross-sectional view of a closure in accordance with this invention and shows it in relation to a container in both sealed and unsealed condition, FIGS. 2 and 3 are schematic cross-sections of the closure in accordance with this invention and indicates forces which act on the closure and resultants of those forces, and FIGS. 4–6 are fragmentary cross-sections of alternative closures in accordance with this invention.

The closure shown in FIG. 1 comprises a top 1 having an upper side 2 and a lower side 3. Projecting downwardly from the lower side is a first annular ring 4 having sealing lips 6 and 7 and a second annular ring which will hereinafter be called capture or first flange 8.

A skirt 9 depends from the top and is internally screw threaded at 11 and has an inwardly directed resilient, second flange 12. The flange 12 tapers towards its free end. The skirt is ribbed, knurled or otherwise treated at 16 to provide grip.

The closure of FIG. 1 is for use with a container having a neck 17 and a finish comprised of a bead 18, screw threads 19, a step 20, a surface 21, a top seal surface 22 and a neck inside surface 23.

The closure is of resilient synthetic plastics material.

It is to be observed that the closure is not provided with any sealant wad or sealant compound.

In use the closure is screwed on to the container and as it is screwed down the resilient flange 12 will firstly come into contact with the top seal surface 22 and thereafter will be drawn over the surface 21 and step 20 and will be stretched in the process so that its natural resilience will cause it to closely conform with and seal against the surface 21 and step 20.

In addition, the capture flange 8 will press down upon the flange 12 and will wedgingly capture it and cause it to more tightly engage with the surface 21 and step 20. Further, the capture flange 8 will be deformed outwardly by the surface 21 and its natural resilience will exert an inward force which will promote sealing.

Still further, the ring 4 will come down on the top seal surface 22 and seal therewith through the lips 6 and 7.

It should be noted that two sealed annular chambers 30 and 31 are formed in the sealing process.

After the ring 4 has contacted the surface 22 the top 1 inboard of the ring 4 will not move further downwardly excepting to some slight extent but the skirt can continue to be screwed on to the container so that the top 1 will deform about its perimeter as shown by a chain line in FIG. 2 with pivoting occurring about ring 4 at surface 22. This will cause the capture flange 8 to move in the direction of arrow 33 to further promote sealing.

If the container is under pressure such as by containing a carbonated beverage pressure within may cause the top 1 to dome upwardly as indicated by chain line 1' in FIG. 3 and the seal of the ring 4 with the surface 22 will be prejudiced but this doming will cause movement of the capture flange 8 in the direction of arrow 34 as indicated by a chain line in FIG. 3 to further promote sealing.

The above described closure is suitable for use on many containers but will probably find major application as a closure for bottles containing carbonated beverages.

The above described closure has the following advantages. It provides a good seal, it can be opened and thereafter resealed, sealing occurs at a substantial number of locations and over a substantial area, the sealing is tight without needing excessive force to achieve it, no sealant wad or sealant compound is required, the closure vents relatively early in the process of unscrewing rather than relatively late and this is likely to avoid danger of the closure being blown off into a user's eye, in this respect, the left hand side of FIG. 1 shows no sealing but that the threading 11 is still engaged with the threading 19, the chambers 30 and 31, particularly the former, provide cushioning against damage, further, bottles are normally filled with cold beverage and later return to room temperature and thus air entrapped in chamber 30 will expand to further promote sealing by forcing flange 12 and flange 8 into tighter engagement with the container, the air in chamber 30 will be compressed by the deformation of flanges 12 and 8 and will thus exert a sealing force, the flange 12 tapers towards its free end and is chamfered thereat so that pressure tending to escape past flange 8 into chamber 30 will tend to promote sealing of flange 12, no seal is made with the surface 23 which is a notorious variable surface due to blow-aways occurring in manufacture whereas sealing is with surfaces 22, 21 and step 20 which are part of the finish and which are less variable from container to container, the container is in no way special so no special moulding of containers is required, pilfer proof features may be added, the closure is not restricted merely to using screw-threading, the flanges 8 and 12 and ring 4 are so positioned as to be unlikely to be damaged by containers which have faults such as overpress, plunger push through and bad ring seams, the closure need not be of sharp finger lacerating metal and has other advantages.

FIGS. 4–6 show alternatives having slightly different shaped rings 41, 42 and 43, capture flanges 81, 82 and 83 and resilient flanges 121, 122 and 123.

Modifications and adaptations may be made to the above described without departing from the spirit and scope of this invention which includes every novel feature and combination of features disclosed herein.

I claim:

1. A closure comprising a top, a depending skirt, a first flange depending from the top and spaced from the skirt, and a resilient second flange on the depending skirt extending inwardly and which is deformable on moving the closure onto the finish of a container to conform against the outside side wall of the neck of the container and wherein said first flange is adapted to engage with said second flange to force said second flange into close conformity with the outside side wall or the top radius of the neck of the container.

2. A closure as claimed in claim 1, wherein said second flange is so located as to be deformed upwardly and outwardly when moved onto the container from above.

3. A closure as claimed in claim 1, wherein said first flange and said second flange, when so engaged, at least in part define a closed annular chamber.

4. A closure as claimed in claim 3, wherein said first flange and said second flange are such that said chamber is adjacent, in use, the top seal surface of the finish of the container.

5. A closure as claimed in claim 1, wherein said resilient flange is so located that pressure within the container tending to escape will press said resilient flange into close conformity with said neck.

6. A closure as claimed in claim 1, including an abutment on the underside of the top.

7. A closure as claimed in claim 6, wherein the abutment is adapted to come into sealing abutting relation with the top seal surface of the container.

8. A closure as claimed in claim 7, wherein the abutment is such as to space the top, in use, above the top seal surface so that after the abutting relation is established further downward movement of the skirt onto the container will cause a pivoting about the abutment having an inward component of motion which will more tightly than otherwise force said resilient flange and said first flange into engagement with the container.

9. A closure as claimed in claim 1, wherein said first flange is such that doming of the closure in use in consequence of internal pressure within the container will cause an inward component of motion of said first flange which will more tightly than otherwise seal the container.

* * * * *